US005598988A

United States Patent [19]

Bukur

[11] Patent Number: 5,598,988

[45] Date of Patent: Feb. 4, 1997

[54] ROTARY FLYER

[76] Inventor: Thomas J. Bukur, 1455 Mississnewa Ct., Valparaiso, Ind. 46383

[21] Appl. No.: 421,746

[22] Filed: Apr. 13, 1995

[51] Int. Cl.[6] ..... B64C 31/06

[52] U.S. Cl. ..... 244/153 A; 244/153 R; 244/155 R

[58] Field of Search ..... 244/153 A, 153 R, 244/155 R, 155 A

[56] References Cited

U.S. PATENT DOCUMENTS

| | | | |
|---|---|---|---|
| D. 160,910 | 11/1950 | Wolford | D34/15 |
| D. 169,290 | 4/1953 | Sneed | 244/154 |
| D. 169,291 | 4/1953 | Spanvill | 244/153 R |
| D. 171,327 | 1/1954 | Gould | 244/153 R |
| D. 177,577 | 5/1956 | Martin | 244/153 A |
| 701,106 | 5/1902 | Trainor | 244/153 R |
| 966,143 | 8/1910 | Van Wie | 244/153 R |
| 1,051,659 | 1/1913 | Ames | 244/153 R |
| 1,494,453 | 5/1924 | Wanner | 244/153 R |
| 2,107,808 | 2/1938 | Van Ittersum | 244/153 R |
| 2,151,349 | 3/1939 | Fromme | 244/153 A |
| 2,442,846 | 6/1948 | Dunn | 244/154 |
| 2,472,290 | 6/1949 | Fernstrum | 244/154 |
| 2,494,430 | 1/1950 | Carnwath | 244/153 A |
| 2,501,442 | 3/1950 | Donaldson | 244/153 A |
| 2,556,877 | 6/1951 | Howard | 244/155 A |
| 2,613,894 | 10/1952 | Howard | 244/155 A |
| 2,613,895 | 10/1952 | Howard | 244/153 R |
| 2,733,880 | 2/1956 | Burrell et al. | 244/153 R |
| 2,763,958 | 9/1956 | Lemelson | 46/89 |
| 2,768,473 | 10/1956 | Taggart | 244/153 R |
| 2,768,803 | 10/1956 | Smith | 244/153 A |
| 2,801,063 | 7/1957 | O'Gorman | 244/154 |
| 2,811,327 | 10/1957 | Roe | 244/153 R |
| 2,812,914 | 11/1957 | Williams | 244/153 R |
| 2,835,462 | 5/1958 | Martin | 244/153 A |
| 2,903,207 | 9/1959 | Wilson | 244/153 R |
| 2,987,280 | 6/1961 | Aylor | 244/153 R |
| 3,026,073 | 3/1962 | Albertson, Jr. | 244/153 A |
| 3,079,115 | 2/1963 | Edwards, Jr. et al. | 244/153 A |
| 3,079,116 | 2/1963 | Trimble | 244/153 R |
| 3,086,737 | 4/1963 | Hyman | 244/153 R |
| 3,086,738 | 4/1963 | Lubash | 244/153 A |
| 3,087,698 | 4/1963 | Mullinix | 244/153 A |
| 3,107,888 | 10/1963 | Finn | 244/153 R |
| 3,108,770 | 10/1963 | Mullinix | 244/153 A |
| 3,116,043 | 12/1963 | Levy | 244/153 R |
| 3,255,985 | 6/1966 | Albertson, Jr. | 244/153 A |
| 3,270,895 | 9/1966 | Stewart | 212/71 |
| 3,330,511 | 7/1967 | Frier | 244/153 R |
| 3,330,512 | 7/1967 | Null | 244/153 R |
| 3,439,887 | 4/1969 | Boehler et al. | 244/153 A |
| 3,526,377 | 9/1970 | Flatau | 244/153 R |
| 3,612,450 | 10/1971 | Sinka | 244/153 R |
| 3,664,613 | 5/1972 | Johnston | 244/155 R |
| 3,687,403 | 8/1972 | Guinn | 244/155 R |
| 3,740,009 | 6/1973 | Curtis | 244/153 R |
| 3,952,975 | 4/1976 | Laske | 244/153 R |
| 3,954,236 | 5/1976 | Brown | 244/155 R |
| 3,960,346 | 6/1976 | Cho | 244/155 A |
| 3,997,136 | 12/1976 | Finn et al. | 244/153 R |
| 4,012,017 | 3/1977 | Springston et al. | 244/153 R |
| 4,078,745 | 3/1978 | Knight et al. | 244/153 A |
| 4,078,746 | 3/1978 | Harris | 244/153 A |
| 4,084,102 | 4/1978 | Fry et al. | 290/55 |
| 4,113,209 | 9/1978 | Rodgers | 244/153 A |
| 4,121,794 | 10/1978 | Lemelson | 244/153 A |
| 4,154,017 | 5/1979 | Bilardi et al. | 46/75 |
| 4,209,936 | 7/1980 | Sklar | 46/240 |
| 4,243,190 | 1/1981 | Sams | 244/153 A |
| 4,577,815 | 3/1986 | Orazi | 244/39 |

(List continued on next page.)

FOREIGN PATENT DOCUMENTS

| | | | |
|---|---|---|---|
| 2546849 | 12/1984 | France | 244/153 A |

*Primary Examiner*—Christopher P. Ellis
*Attorney, Agent, or Firm*—Patula & Associates

[57] ABSTRACT

A rotating flying device of the type having an airfoil and a stabilizer disk is disclosed. The flying device uses novel three-hole bearings to allow for flight with streamers. Further, the flying device may be folded for ease in transportation or storage. Stabilizing elements are used to hold the disk in a flying position.

30 Claims, 4 Drawing Sheets

U.S. PATENT DOCUMENTS

| | | | |
|---|---|---|---|
| 4,601,440 | 7/1986 | Wang | 242/96 |
| 4,606,518 | 8/1986 | Jeffrey | 244/153 A |
| 4,624,648 | 11/1986 | Waters | 446/176 |
| 4,752,051 | 6/1988 | Chang | 244/155 R |
| 4,752,052 | 6/1988 | Galvin | 244/3.29 |
| 4,779,825 | 10/1988 | Sams | 244/153 A |
| 4,790,498 | 12/1988 | Jeffrey | 244/153 A |
| 4,848,704 | 7/1989 | Sams | 244/153 A |
| 4,871,133 | 10/1989 | Alonso | 244/153 R |
| 4,874,146 | 10/1989 | Heid | 244/153 R |
| 4,878,636 | 11/1989 | Mileti | 244/155 A |
| 4,884,765 | 12/1989 | Renecle | 244/153 R |
| 4,892,272 | 1/1990 | Hadzicki | 244/153 R |
| 4,911,383 | 3/1990 | Elson | 244/153 R |
| 4,911,384 | 3/1990 | Stankus | 244/153 R |
| 4,915,320 | 4/1990 | Neal | 242/96 |
| 4,919,365 | 4/1990 | Mears | 244/153 R |
| 4,927,100 | 5/1990 | Provenzo, Jr. et al. | 244/153 R |
| 4,930,726 | 6/1990 | Jalbert | 244/90 R |
| 4,942,506 | 7/1990 | Flory | 362/253 |
| 4,958,787 | 9/1990 | Sterling | 244/153 R |
| 4,969,615 | 11/1990 | Gellert | 244/153 R |
| 4,981,271 | 1/1991 | Carter | 242/96 |
| 4,981,273 | 1/1991 | Petteys | 244/153 R |
| 4,988,059 | 1/1991 | Allee | 244/153 R |
| 5,000,401 | 3/1991 | Barone | 244/153 R |
| 5,000,402 | 3/1991 | Blackburn | 244/153 R |
| 5,072,899 | 12/1991 | Nickle | 244/155 R |
| 5,183,224 | 2/1993 | Harburg | 244/155 R X |
| 5,213,269 | 5/1993 | Srinath et al. | 239/589.1 |
| 5,234,182 | 8/1993 | Renecle | 244/153 R |
| 5,251,854 | 10/1993 | Iwamoto | 244/153 R |
| 5,277,350 | 1/1994 | Thornbury, Jr. | 244/155 A |
| 5,288,038 | 2/1994 | Duong | 244/153 R |
| 5,322,247 | 6/1994 | Munday et al. | 244/153 R |
| 5,328,134 | 7/1994 | Powers | 244/155 A |
| 5,352,144 | 10/1994 | Kuhn | 446/176 |
| 5,366,182 | 11/1994 | Roeseler et al. | 244/155 R |

ROTARY FLYER

BACKGROUND OF THE INVENTION

Flying toys, especially kites, having long been used by all types of people for fun and entertainment. Kites come in all shapes and sizes. One particular type of kite is known as a rotatable airfoil kite. Such kites generally comprise a single elongated airfoil element or wing. This wing contains a circular disk member or stabilizer disk preferably attached at the center portion of the wing.

Various examples of rotatable kites are shown in U.S. Pat. No. 3,079,115 to Edwards, Jr., et al., in U.S. Pat. No. 4,012,017 to Springston, et al., in U.S. Pat. No. 4,121,794 to Lemelson, in U.S. Pat. No. 4,606,518 to Jeffrey, in U.S. Pat. No. 4,779,825 to Sams, and in U.S. Pat. No. 4,790,498 to Jeffrey.

However, these known rotatable kites present several disadvantages to users. Generally, these kites are not very durable and tend to break on impact with the ground or other objects, or even due to a strong wind force. Also, these kites are expensive, cumbersome, hard to assemble, hard to transport, and unstable in flight. Further, these kites are incapable of being flown with tails or streamers.

The present invention solves the problems or disadvantages of known rotatable kites. The invention is lightweight yet very durable. It can be assembled with ease. The invention has a novel characteristic of being foldable for transportation or storage, while at the same time being stable in flight. The invention is specifically designed to be capable of flying with tails or streamers. Further, the invention is inexpensive and easy to fly.

Edwards, Jr., et al. (U.S. Pat. No. 3,079,115) disclose a rotatable kite having a wing and a stabilizer disk. However, the kite is difficult to assemble due to plurality of tabs and slots which must be interconnected. Further, the kite is incapable of being folded for transportation and makes no provisions for flying with streamers.

Springston, et al. (U.S. Pat. No. 4,012,017) discloses a rotatable kite having a wing and two stabilizer disks. However, the kite is difficult to assemble due to the two disk design, and the need for bracing line. Further, the kite is incapable of being folded for transportation and makes no provisions for flying with streamers.

Lemelson (U.S. Pat. No. 4,121,794) discloses a relatively simple rotatable kite having a wing and a stabilizer disk. However, the kite is incapable of folding for transportation and makes no provisions for flying with streamers.

Jeffrey (U.S. Pat. No. 4,606,518) discloses another relatively simple rotatable kite having a wing and a stabilizer disk. However, the kite is incapable of folding for transportation and makes no provisions for flying with streamers.

Sams (U.S. Pat. No. 4,779,825) discloses various rotatable kites which are complex and difficult to assemble. Sams also discloses the use of cushioning strips covered with hinge tape to allow for movement of the stabilizer disk. However, these strips are used to prevent the disk from folding completely flat against the wing, unlike the present invention which is capable of such folding. Sams' disk is capable of movement during flight, unlike the present invention whose disk is stable during flight. Further, Sams makes no provisions for flying with streamers.

Jeffrey (U.S. Pat. No. 4,790,498) discloses a rotatable kite having a wing and a stabilizer disk. However, the kite is difficult to assemble due to a pair of closely spaced radially extending support elements. Further, the kite is incapable of folding and makes no provision for flying with streamers.

BRIEF SUMMARY OF THE INVENTION

The invention consists of an improved rotatable flying kite designed specifically to fly with streamers and also to be completely foldable for ease in transportation or storage, while at the same time maintaining stable flying characteristics. The invention is manufactured to be durable, lightweight, easy to assemble and repair, and inexpensive.

In order to be able to fly with streamers, the invention utilizes novel three-hold bearings, to which the streamers are attached. The invention is also equipped with means to hold the streamers away from the rotating members of the kite so that they do not become entangled therewith.

The invention, once assembled, is capable of being completely folded when not in use to facilitate transportation. The invention utilizes novel blockers or stabilizing elements to prevent the kite from folding or wobbling during flight.

It is the principle object of the present invention to provide an improved rotatable flying kite.

It is a further object of the present invention to provide streamers for a rotatable flying kite.

It is also an object of the present invention to provide a rotatable flying kite capable of being completely folded when not in use, while at the same time maintaining stable flying characteristics.

It is an additional object of the present invention to provide a rotatable flying kite that is lightweight, durable, simple in construction and assembly, easy to repair, and inexpensive.

It is another object of the invention to provide novel three-hole bearings for a rotatable flying kite.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1:
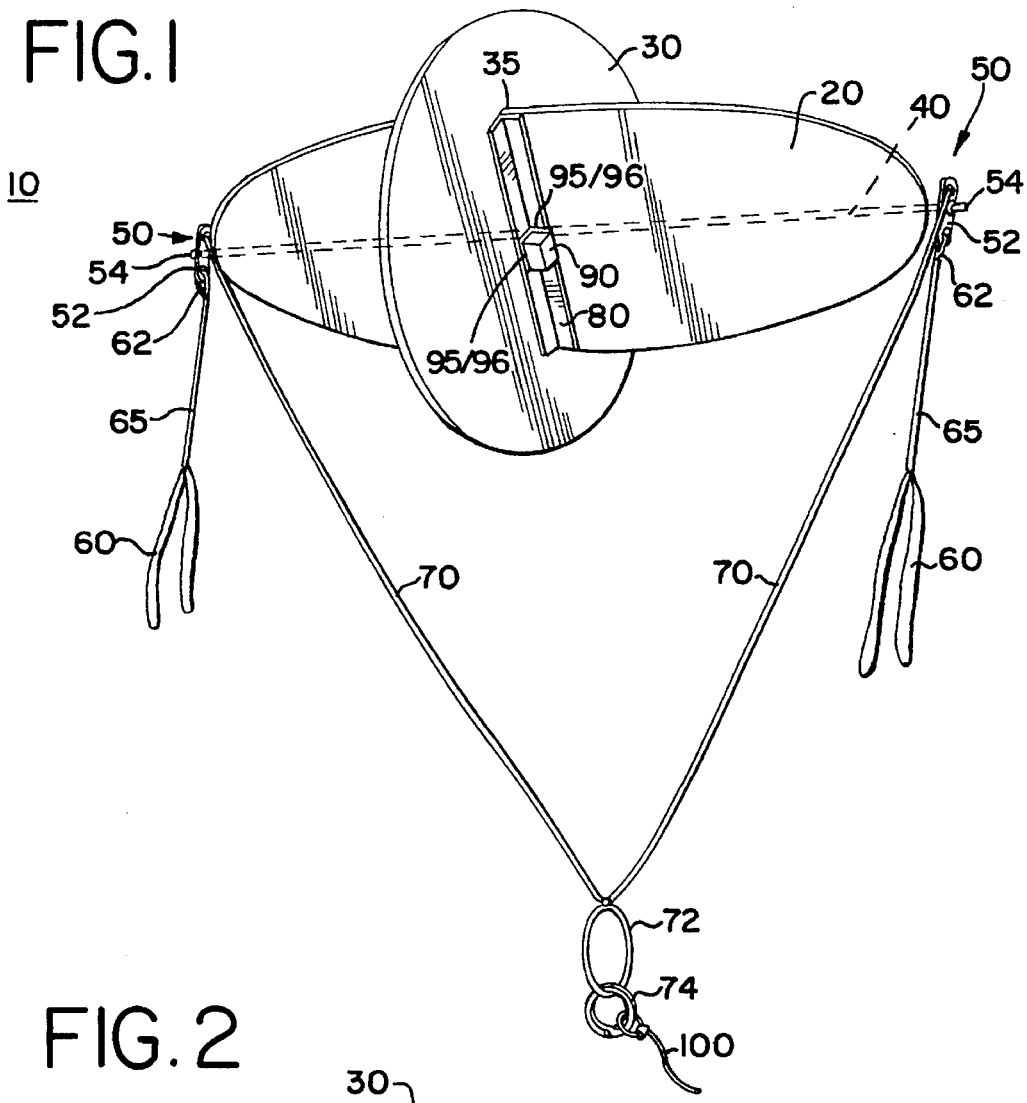
FIG. 1 is a perspective view of the preferred embodiment of the present invention in its flying position.

While the invention is susceptible of embodiment in many different forms, there is shown in the drawings and will be described herein in detail, a preferred embodiment of the present invention. It should be understood, however, that the present disclosure is to be considered an exemplification of the principles of the invention and is not intended to limit the spirit and scope of the invention and/or claims of the embodiment illustrated.

FIGS. 1 through 14 illustrate the present invention 10, as well as alternate embodiments, comprising an airfoil or wing 20 and a stabilizer disk 30. Disk 30 contains a slot 35 for receiving the wing 20. A rigid dowel or rod 40, preferably made of a strong, lightweight material, for example wood or other materials, is attached along the length of the wing 20. Attached to the ends of the rod 40 is bearing assembly 50. Attached to each bearing assembly 50 are the streamers 60 and kite bridle 70.

Referring now to FIG. 1, the invention 10 is shown in its flying position. Wing 20 is oval shaped and is inserted through slot 35 in disk 30. Disk 30 is centered on and perpendicular to wing 20. Wing 20 and disk 30 are preferably made of styrofoam. A layer of poly-coated beaded paper is attached to each side of the wing 20 and disk 30. This paper adds strength to the kite and allows silk screening or decoration of the kite. Alternatively, a layer of plastic film coating is attached to each side of the wing and disk. This plastic film coating is extremely durable, yet flexible.

Figure 10:
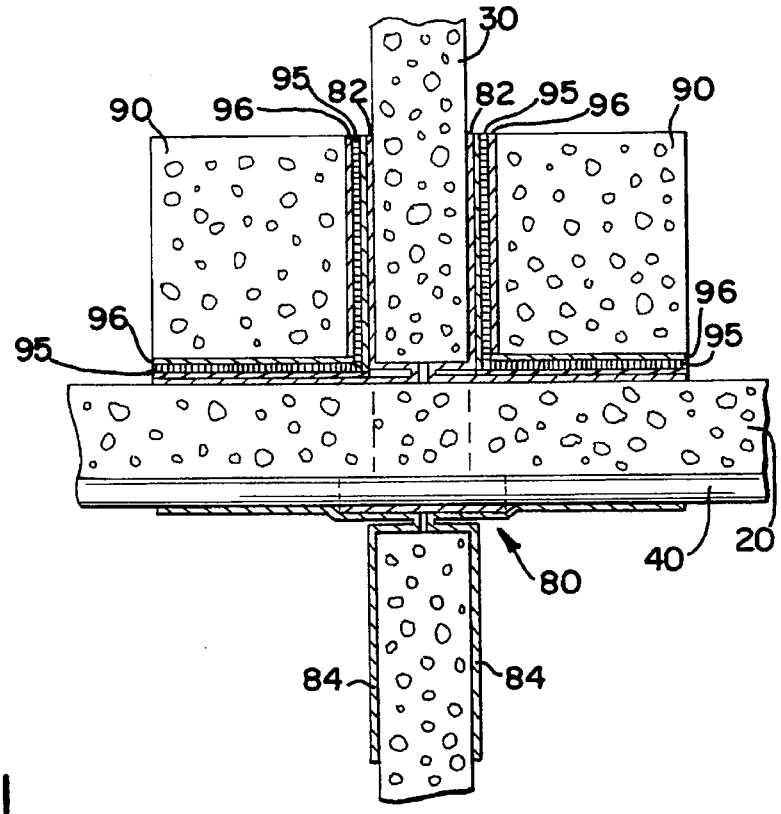
FIG. 10 is a cross-sectional view of the intersection of the airfoil and stabilizer disk of the present invention.

Disk 30 is anchored to wing 20, at their intersection, by connecting means, preferably nylon tape. Nylon tape is strong and easy to work with, however, any suitable tape may be used. Tape 80 is placed along all four quadrants of the intersecting wing 20 and disk 30 to form a double hinge (as seen in FIG. 10). Disk 30 is free to rotate about this double hinge until prevented from doing so by contacting wing 20. To keep disk 30 from rotating during flight, and maintaining a perpendicular orientation to wing 20, two stabilizing elements or blockers 90 are used. Blockers 90 are removably connected by suitable fastening material 95 and 96, such as hook and loop type fasteners, to the wing 20 and disk 30, at the intersection, to prevent disk 30 from rotating about the double hinge.

Figure 4:
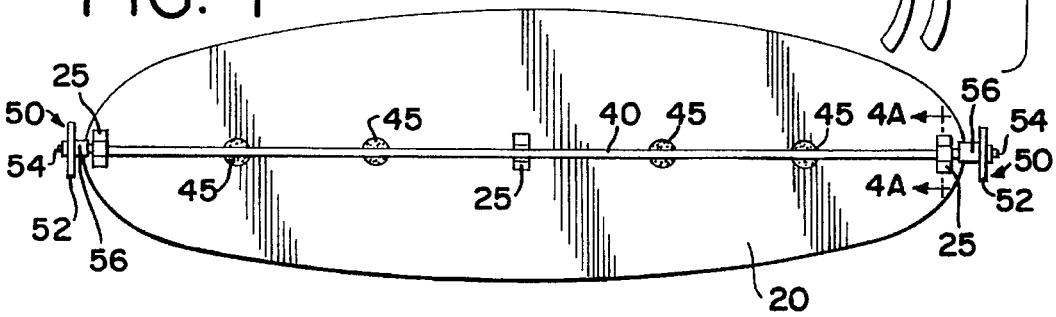
FIG. 4 is a top view of the airfoil of the present invent ion.

A rod 40 is centered on and attached to wing 20. The rod 40 provides rigidity to wing 20 and also provides an axis for the invention 10 to rotate about. The rod 40 is attached to wing 20 preferably by three U-clamps 25 (see FIGS. 2, 4, 5, and 7), one in the center and two on the ends of wing 20. Rod 40 is also preferably tack-welded or attached by hook and loop fasteners to wing 20 in four equally spaced locations to prevent the rod from rotating relative to wing 20 (as seen in FIG. 4).

The ends of rod 40 extend a short distance past the ends of wing 20. This overhang or extension of rod 40 allows a bearing assembly 50 to be placed on the ends of the rod. Bearing assembly 50 comprises a three-hole bearing 52. The bearing 52 can be made of any suitable material, but is preferably flexible plastic. The bearing is preferably a flat, rectangular shape having three equally spaced, linear holes. The center hole of bearings 52 is placed on the ends of rod 40. Bearings 52 are prevented from sliding off rod 40 by end caps 54.

Figure 12:
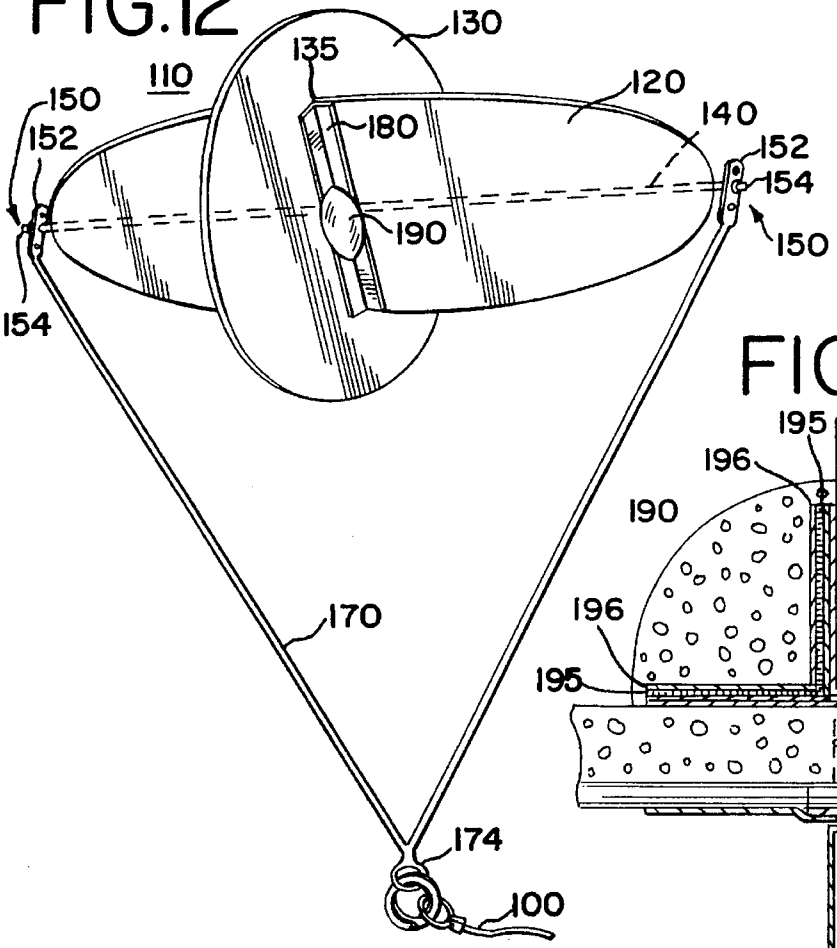
FIG. 12 is a perspective view of an alternate embodiment of the present invention in its flying position.

Connected to either of the outer two holes of the three-hole bearing 52 is one end of a bridle 70. Bridle 70 preferably ends in a loop 72 to which a split ring 74 is attached. Kite line 100 is then connected to the split ring 74 on loop 72 of bridle 70. Line 100 is preferably fishing line which is strong yet hard to see, so that invention 10 appears to be floating in the air by itself. Further, as the fishing line vibrates from the rotation of invention 10 and from the wind, the line makes a noise giving the invention 10 an eerie appearance to an observer. Connected to the other of the outer two holes, by suitable connectors 62, preferably a split ring or a swivel clip, is the streamer 60. Tubular member 65 is provided to prevent the streamer 60 from becoming entangled with the other parts of the invention 10. In an alternate embodiment, the bearings 52 and bridle 70 are an integral, one piece, stamped V-bridle as illustrated in FIG. 12.

Figure 2:
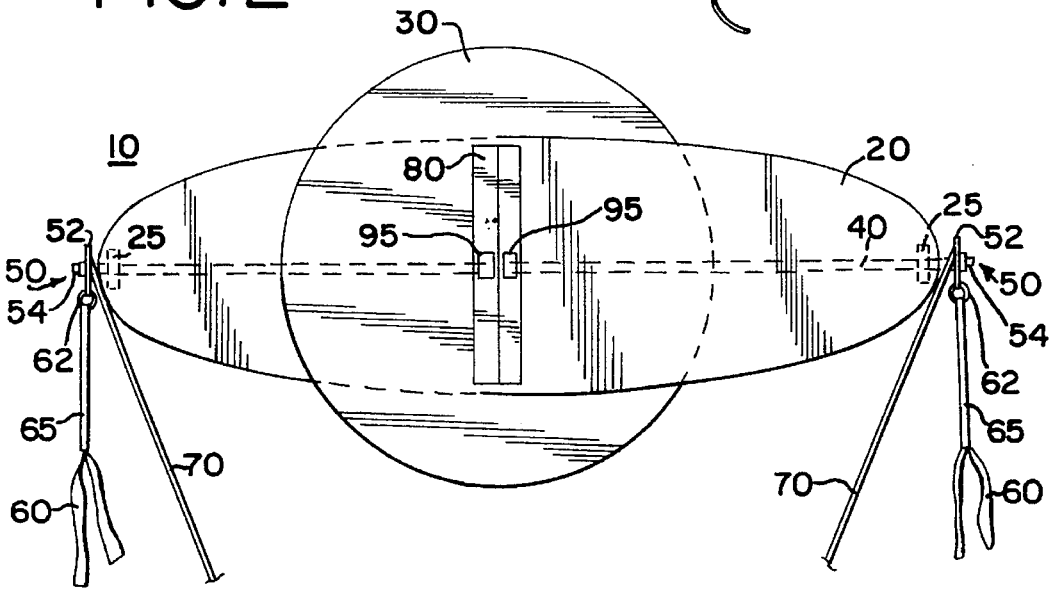
FIG. 2 is a top view of the present invention in its folded position.

FIG. 2 illustrates the invention 10 in its folded position. Blockers 90 have been removed, thereby allowing for the movement of disk 30 about the double hinge formed by tape 80. Disk 30 is rotated in either direction until coming into contact with wing 20. Invention 10 is thus easily transportable or storable, taking up far less space than a normal rotatable kite.

FIG. 2 also illustrates rod 40, U-clamps 25, bearing assemblies 50 comprising three-hole bearings 52, and end caps 54, streamers 60, connectors 62, tubular members 65, bridle 70, and fastening material 95.

Figure 3:
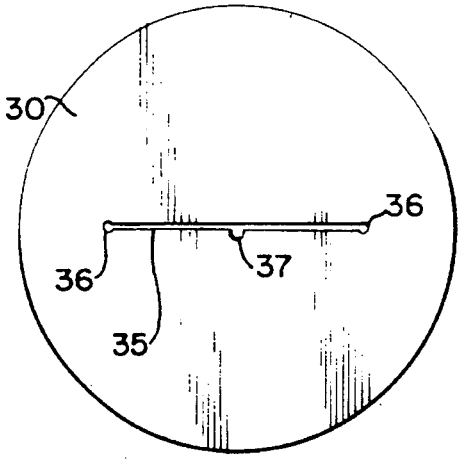
FIG. 3 is a side view of the stabilizer disk of the present invention.

FIG. 3 illustrates stabilizer disk 30 having slot 35 at the center thereof. Slot 35 is of sufficient length to allow for the insertion of wing 20. The ends 36 of slot 35 are over-cut in a circular fashion to allow for slight deformations in disk 30 when in its folded position, thereby preventing disk 30 from tearing at the slot ends 36. The center of slot 35 contains notch 37 to make room for rod 40 and U-clamp 25 to be inserted therein. Ends 36 may be reinforced or repaired by applying glue or tape around its inside edges.

FIG. 4 illustrates airfoil or wing 20. Rod 40 is frictionally held to wing 20 by U-clamps 25. However, rod 40 may additionally be tack-welded or glued with an adhesive or connected by hook and loop fasteners or other suitable attachment means 45 to prevent rotation of the rod. Bearing assemblies 50 are attached on the ends of rod 40. Bearings 52 are prevented from leaving rod 40 by caps 54. Bearings 52 are prevented from contacting wing 20 by tubular spacers 56 placed on the ends of rod 40.

Figure 4A:
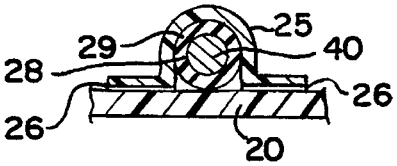
FIG. 4A is a cross-sectional view of a U-clamp of the present invention taken along line 4A—4A of FIG. 4.

FIG. 4A illustrates how the U-clamps 25 are attached to wing 20. U-clamp 25 has stick pads or adhesive 26 attached to its horizontal flanges. U-clamp is placed over rod 40 and pressed down on wing 20 such that stick pads 26 adhere to wing 20, thereby securely holding rod 40 in place on wing 20. Preferably, rod 40 is first wrapped with a resilient foam rubber material 28 before U-clamp 25 is placed thereover. Material 28 has a width equal to that of the U-clamp 25 and is of sufficient length to wrap around rod 40 at least one full time. The inner surface 29 of material 28 includes an adhesive so that material 28 is securely fastened to dowel rod 40 when U-clamp 25 is placed thereover. The use of resilient foam rubber material 28 is desired so that if rod 40 cracks or breaks, the rod 40 can be removed from U-clamp 25, and a new rod inserted therethrough, without the need for the U-clamp to be removed. Attachment means 45 (FIG. 4) are preferably hook and loop fasteners to allow the rod 40 to be instantly repairable.

Figure 5:
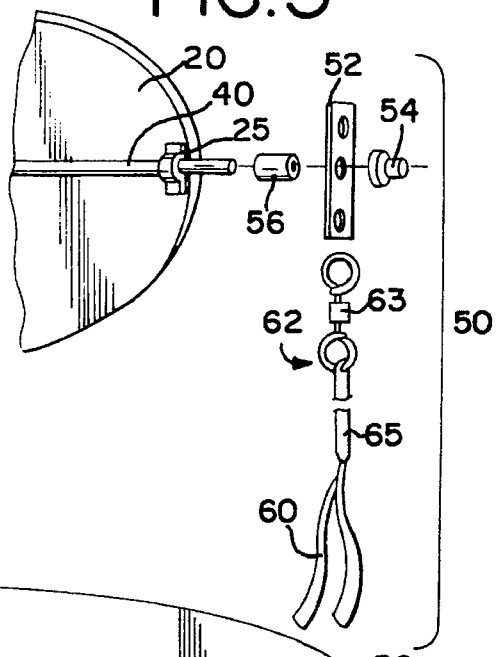
FIG. 5 is an exploded perspective view of the three-hole bearing assembly of the present invention.
Figure 9:
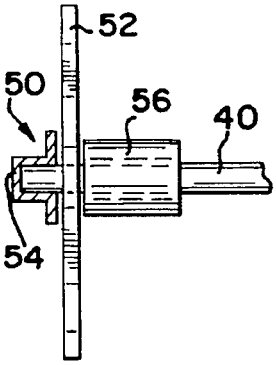
FIG. 9 is an enlarged side view of the three-hole bearing assembly of the present invention.

FIG. 5 illustrates bearing assembly 50 attached to an end of rod 40. Bearing assembly 50 consists of three-hole bearing 52, cap 54, and spacer 56. Spacer 56 is an extruded vinyl tube which is placed on the end of rod 40 and fits snugly thereto. Spacer 56 is placed as far onto rod 40 as possible, i.e., until contacting wing 20. Spacer 56 is of sufficient length to allow the end of rod 40 to extend therefrom. The center hole of three-hole bearing 52 is next placed over the end of rod 40. Cap 54 is then placed on the end of rod 40. The distance between spacer 56 and cap 54 should be sufficient to allow bearing 52 to freely rotate on rod 40 (as seen in FIG. 9). Streamer 60 is attached to an outer hole of three-hole bearing 52 by connector 62, illustrated in FIG. 5 as a swivel 63, preferably a snap swivel. Tubular member 65 holds the streamer 60 away from, and prevents tangling with, the other parts of the invention 10.

Figure 6:
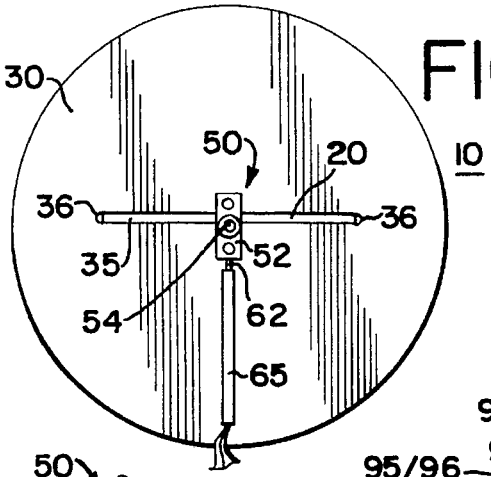
FIG. 6 is a side view of the present invention in its flying position.

FIG. 6 is a side view of invention 10 illustrating disk 30 having slot 35 with over-cut slot ends 36, wing 20 inserted in slot 35, bearing assembly 50 having bearing 52 and cap 54, streamer 60 attached to bearing 52 by connector 62, and tubular member 65.

Figure 7:
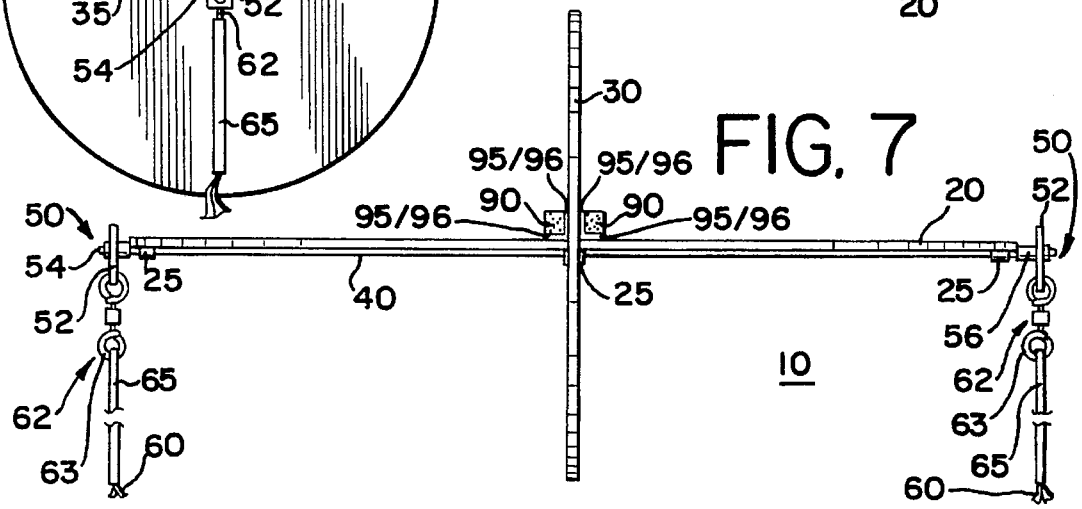
FIG. 7 is a front view of the present invention in its flying position.
Figure 13:
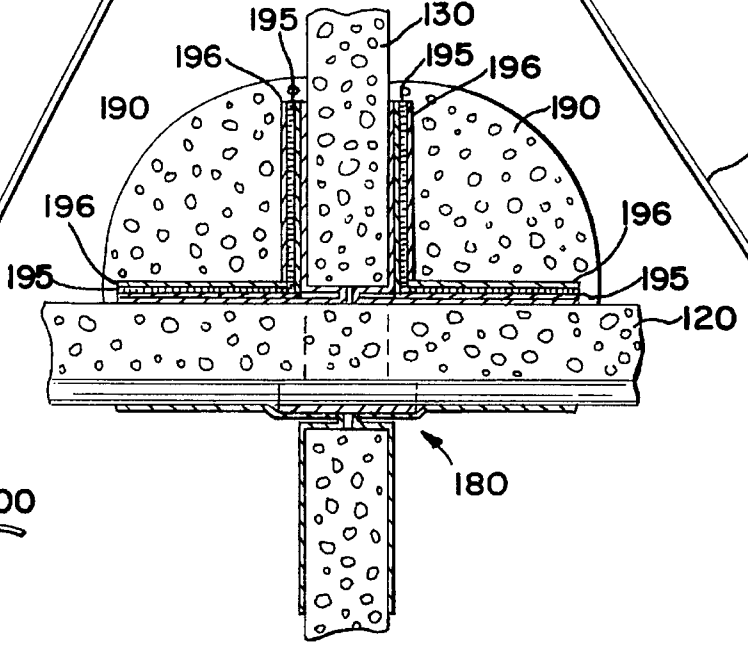
FIG. 13 is a cross-sectional view of the intersection of the airfoil and stabilizer disk of the alternate embodiment of FIG. 12.

FIG. 7 is a front view of invention 10. Wing 20 is inserted through disk 30 with disk 30 being centered thereon. Rod 40 is held on one side of wing 20 by three U-clamps, one in the center, resting in notch 37 of slot 35 of disk 30, and two on the ends of wing 20. Four pieces of fastening material 95 are placed perpendicularly at the intersection, on the side opposite rod 40, two on disk 30 and two on wing 20. Four pieces of complimentary fastening material 96 are placed perpendicularly on blockers 90 (two pieces on each blocker). Blockers 90 are then fastened to the intersection to hold disk 30 in a flying position and are removable to allow disk 30 to rotate to a folded position. Blockers 90 are illustrated as two elements disposed on the same side of wing 20. However, the blockers could be diagonally opposed or four blockers could be used, one in each quadrant of the intersecting wing and disk. Further, blockers 90 could be spherical as illustrated in FIGS. 12 and 13.

Bearing assemblies 50 are attached to the ends of rod 40. Spacers 56 are inserted over rod 40 until contacting wing 20. Three-hole bearings 52 are next inserted over rod 40. Caps 54 are then placed on the ends of rod 40. A connector 62, preferably swivel 63, connects streamers 60 to three-hole bearings 52. Tubular members 65 prevent streamers 60 from becoming entangled with bearing assemblies 50.

Figure 8:
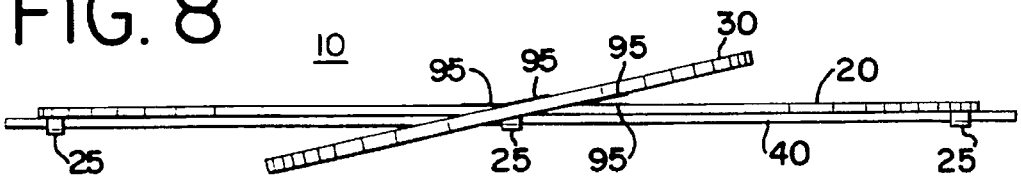
FIG. 8 is a side view of the present invention in a partially folded position.

FIG. 8 illustrates the foldability of stabilizer disk 30. When the blockers 90 of FIG. 7 are removed, disk 30 is free to pivot in either direction about the double hinge formed by tape 80, until disk 30 contacts wing 20. As can be seen, the two pieces of fastening material 95 on one side of disk 30 become folded on top of each other, while the two pieces of fastening material 95 on the other side of disk 30 become substantially linear.

FIG. 9 is a close-up side view of the bearing assembly of the present invention. Spacer 56 is inserted over the end of rod 40. Bearing 52 is next placed onto rod 40 through the center hole of bearing 52. A cap 54 is then placed on the end of rod 40. As can be seen, cap 54 and spacer 56 are sufficiently spaced apart such that bearing 52 is free to rotate on rod 40 in the space provided between cap 54 and spacer 56.

FIG. 10 illustrates how tape 80 forms the double hinge at the intersection of the disk 30 and wing 20. Six pieces of tape 80 are preferably used to form the double hinge. Two long pieces 82 of tape 80, substantially of length equal to the width of wing 20, are placed on the side opposite the rod 40. Disk 30 is first rotated in one direction until it contacts wing 20. A long piece 82 of tape 80 is placed at the intersection, half on wing 20 and half on disk 30. Disk 30 is then rotated in the other direction until it again contacts wing 20. A second long piece 82 of tape 80 is placed at the intersection, half on wing 20 and half on disk 30. The two long pieces 82 of tape 80 should connect at the intersection, underneath slot 35.

Four short pieces 84 of tape 80, substantially of length equal to one-half the width of wing 20, are placed in a similar fashion on the side of wing 20 having rod 40, two short pieces 84 of tape 80 on each side of rod 40. When in place, the four short pieces 84 of tape 80 resemble the two long pieces 82 of tape 80 but having a gap therein for the rod 40 and U-clamp 25.

Four pieces of fastening material 95 are placed on the long pieces 82 of tape 80 at the center of the intersection. The pieces of fastening material 95 are placed, two on each side of disk 30, so that they are perpendicular when disk 30 is in flying position. It should be understood that eight pieces of fastening material 95 would be used if four blockers were being used.

Complimentary fastening material 96 is placed on perpendicular sides of blockers 90. When blockers 90 are in use, fastening material 95 and 96 coact to hold the blockers 90, and thus disk 30 in position.

Figure 11:
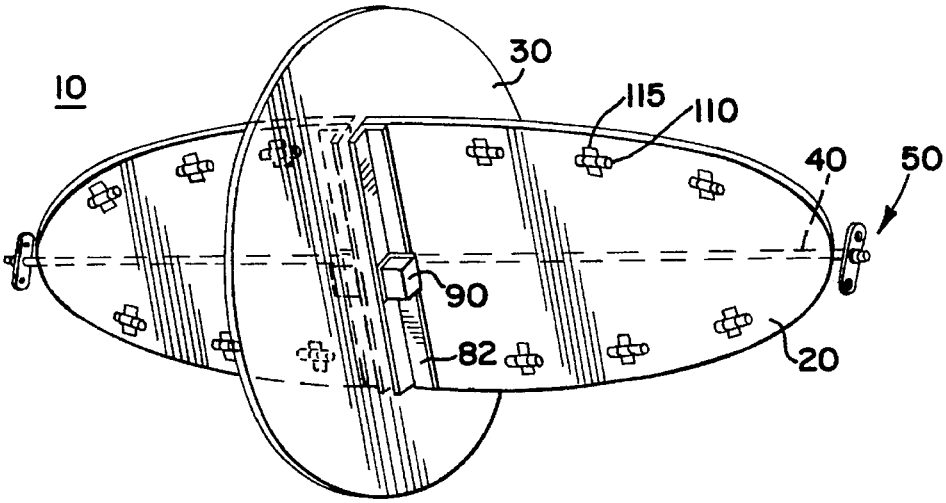
FIG. 11 is a perspective view of the present invention having illuminating means attached thereto.

FIG. 11 shows the present invention 10 with illumination means such as a plurality of neon light tubes 110 suitably attached to wing 20 by attachment means such as U-clamps 115. The illumination means can be placed on the edges of disk 30 and wing 20 so that the invention 10 is outlined as it rotates in the dark.

However, the invention 10 can be painted, decorated or illuminated in any suitable manner. For example, silver tape may be added as a decoration or to reflect radar or light. Such tape could also be applied for extra rigidity to the wings, especially where the wings have cracked or broken and have been glued together. A number of L.E.D.'s may be stuck into the wing 20 or disk 30. A battery could be provided to light the L.E.D.'s.

FIG. 12 shows an alternate embodiment of the invention 110 having wing 120 and disk 130. Wing 120 is oval-shaped and is inserted through slot 135 on disk 130. Disk 130 is centered on and perpendicular to wing 120 in a flying position. Disk 130 is anchored to wing 120, at their intersection, by connecting means 180, preferably nylon tape. Tape 180 is placed along all four quadrants of the intersecting wing 120 and disk 130 to form a double hinge (as seen in FIG. 13). Disk 130 is free to rotate about this double hinge until prevented from doing so by contacting wing 120. To keep disk 130 from rotating during flight, and maintaining a perpendicular orientation to wing 120, a plurality of stabilizing elements or blockers 190 are used. Blockers 190 are illustrated as quartered spheres (as will be described in more detail with reference to FIG. 13).

A wooden rod 140 is centered on and attached to wing 120 by a plurality of U-shaped clamps. The ends of rod 140 extend a short distance past the ends of wing 120. This overhang or extension of rod 140 allows a bearing assembly 150 to be placed on the ends of the rod. Bearing assembly 150 comprises an integral, one piece, stamped, three-hole bearings 152 and V-bridle 170. Integral bearings 152 are preferably a flat rectangular shape having three-equally spaced, linear holes. The V-bridle 170 is integrally connected to and extends from one end of the bearings 152. The center hole of bearings 152 is placed over the ends of rod 140. A simple twist must be imparted to the integral bearings 152 so that the hole can be aligned with rod 140. Bearings 152 are prevented from sliding off rod 140 by end caps 154.

Integrally attached to one end of the three-hole bearings 152 is bridle 170. Bridle 170 ends in an integral ring 174. Line 100, preferably fishing line is attached to ring 174 of bridle 170 by a connector ring. Alternatively, line 100 could be directly attached to integral ring 174. The integral V-bridal, stamped from plastic or other suitable materials, allows the kite line to always be attached at the center of the V-bridal and thus eliminates any error in judging the center, resulting in lopsided and/or diminished flight. A streamer similar to that illustrated in FIG. 1, can be connected to the outer hole of bearing 152 opposite bridle 170, by suitable connectors. Should bridle 170 happen to break, the bridle 170 can be cut at the bearings 152 and a bridle 70 can be attached as described in invention 10.

FIG. 13 is a cross-sectional view of the intersection of the airfoil 120 and stabilizer disk 130 of the invention 110. As can be seen, blockers 190 are illustrated as two quartered spheres which when placed together form a half sphere. Tape 180 is placed along the intersection of disk 130 and wing 120 to from the double hinge in the same manner as described before.

Four pieces of fastening material 195 are placed at the center of the intersection, two in each upper quadrant, perpendicular to each other as described in FIG. 10. The fastening material 195 is preferably hoop and loop fasteners, which are placed on wing 120 and disk 130 on the side opposite rod 140. If four spherical blockers are used, fastening material 195 on the side with rod 140 can be placed off center, or preferably split into two and placed on both sides of rod 140. Each quartered spherical blocker has two planar sides, one which abuts wing 120 and one which abuts disk 130. Each planar side has a recessed portion for receiving complimentary fastening material 196. The recessed portions are cut as deep as the thickness of fastening material 195 and 196 when placed together, such that the planar sides are flush with wing 120 and disk 130. If four blockers are used, the blockers on the side with rod 140 also contain a groove for receiving rod 140 therethrough.

Additionally, for extra strength and stability, a connector can be placed through disk 130 on one or both sides of wing 120, into quartered spherical blockers 190 to securely attach the blockers 190 together. The connector can be any suitable connector such as a cylindrical pin or screw member. Quartered spherical blockers 190 thus securely and removably provide strength and stability, as well as being aesthetically pleasing and aerodynamic.

Figure 14:
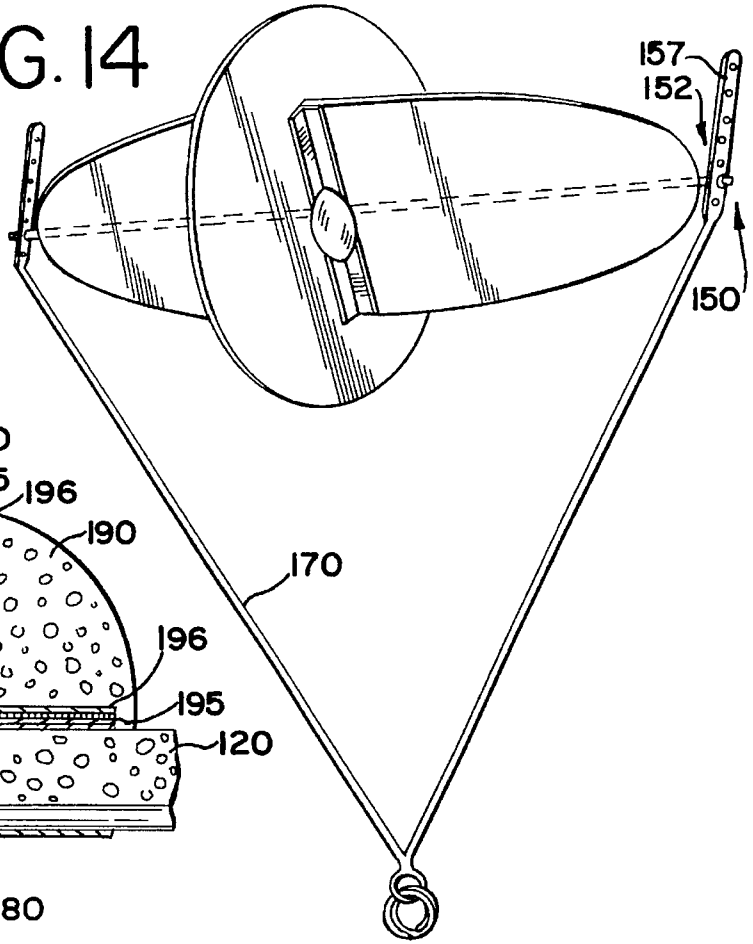
FIG. 14 is an alternate embodiment of the bearing assembly of the present invention.

FIG. 14 illustrates an alternate embodiment of the integral bearing assembly and V-bridal 150/170 of FIG. 12. In this embodiment, bearing 152 of bearing assembly 150 comprises an integral extension 157 at its free end. A plurality of holes are provided in extension 157. In use, since extension 157 extends a distance away from rod 140 and wing 120, a streamer can be attached directly thereto, without the use of a tubular member as described above. Further, additional attachments could be made, in addition to the streamer. For example, bells and/or whistles could be attached via any of the unused bearing holes.

Rod 140 could also be positioned in any of the plurality of holes. When in use with a streamer, rod 140 is preferably positioned in the first or second hole adjacent V-bridle 170. However, when the present invention is flown without streamers or other attachments, rod 140 is preferably positioned at the hole adjacent the free end of extension 157.

To assemble invention 10, disk 30 is placed over and centered on wing 20. Rod 40 is placed along the longitudinal axis of wing 20. Three U-clamps are placed over rod 40 and attached to wing 20, one at the center and two at the ends. Rod 40 may be tack welded to wing 20 so that rod 40 cannot spin. Four equally spaced welds along rod 40 may be desirable. Smaller sized U-clamps could be used to achieve a similar result.

Tape 80 is next added to the intersection of wing 20 and disk 30 to form the double hinge. Fastening material 95 is then placed on long pieces 82 of tape 80.

Next, the bearing assemblies 50 are attached to the ends of rod 40, one on each end. Spacers 56 are placed over the ends of rod 40, followed by bearings 52 (center hole), and caps 54. The ends of the bridle 70 are tied directly to or suitably connected to an end hole of each of the three-hole bearings 52.

Streamers 60 are attached to the remaining end hole of the three-hole bearings 52. Streamers 60 can be of any length and any material but are preferably made of nylon. The streamer 60 is first looped somewhere along the length of the streamer 60. The loop is then fed through the tubular member 65 in any suitable manner such as pulling it through with a crochet needle or a string. The tubular member 65 can be any suitable tubular member such as a straw. The connector 62, for example a swivel or a split ring, is connected to the end of the loop formed in the streamer 60.

The loop is then tied in a knot and the tubular member 65 is slid all the way up to the connector 62. The knot should be inside the tubular member 65 and should provide proper friction to hold the tubular member 65 in place. The connector 62 is then attached to the end hole of the bearing 52. The invention 10 is now ready to be flown, however, the invention 10 may be flown without the streamer 60 if desired. Also, streamer 60 can be tied directly to an end hole of bearing 52, however this would hamper efforts to attach and detach as desired. Blockers 90 with complimentary fasteners 96 are added for stability. Invention 110 is assembled in a similar manner.

To fly the invention 10, a user, while facing another user holding the end of the kite line, only needs to hold onto the ends of wing 20 and flip it up over his head into the wind, while the other user holds onto the kite line. The wind will lift the kite into the air as the kite rotates about the axis of rod 40.

The invention has been illustrated as having one stabilizer disk. However, it is foreseen that the novel characteristics of the present invention can be applied to an airfoil having two or more stabilizer disks. Also, the invention can be flown with noise makers attached. For example, bells could be attached to the end of V-bridle, or tubular whistles could be attached on the streamers. Further, the stabilizer disk has been illustrated as being held in flying position by blockers. However, it is foreseen that the disk could be held in place by a plurality of hook and rubber bands connecting the ends of the wing in each quadrant, or a plurality of grommets and string connecting the ends of the disk to the ends of the wing in each quadrant. The wing and disk could also be glued together. This however would prevent folding of the disk if desired.

It is to be understood that the embodiments herein described are merely illustrative of the principles of the present invention. Various modifications may be made by those skilled in the art without departing from the spirit or scope of the claims which follow.

I claim:

1. A rotary flying device comprising:

an airfoil having an axis of rotation means for rotation thereabout, said axis of rotation means having two ends;

a stabilizer disk mounted on said airfoil;

a bearing assembly means attached to each end of said axis of rotation means, said bearing assembly means including a streamer attachment means allowing for said rotary flying device to be flown with a steamer at an angle substantially perpendicular to said axis of rotation means; and a bridle means attached to said bearing assembly means for receiving a support line.

2. The flying device of claim 1, wherein said disk contains a slot and said airfoil is placed through said slot, thereby forming an intersection.

3. The flying device of claim 2, wherein said disk is capable of rotating about said intersection, said disk being in a flying position when perpendicular to said airfoil, and said disk being in a folded position when rotated to substantially fully contact said airfoil.

4. The flying device of claim 1, wherein said bearing assembly means comprises a bearing, a spacer, and an end cap.

5. The flying device of claim 4, wherein said bearing contains three holes, said streamer attachment means being one of said three holes.

6. The flying device of claim 5, wherein a streamer is attached to said streamer attachment means.

7. The flying device of claim 6, wherein said streamer is attached to said streamer attachment means by a connector.

8. The flying device of claim 7, wherein said connector is a split ring.

9. The flying device of claim 7, wherein said connector is a swivel.

10. The flying device of claim 6, wherein said streamer passes through a tubular member.

11. The flying device of claim 3, wherein tape covers said intersection so as to form a double hinge.

12. The flying device of claim 3, wherein at least one stabilizer element is removably attached to at least one of said disk and said airfoil at said intersection to securely hold said disk in said flying position.

13. The flying device of claim 12, wherein said at least one stabilizer element is removably attached to at least one of said disk and said airfoil at said intersection by means for fastening.

14. The flying device of claim 13, wherein said means for fastening is hook and loop type fasteners.

15. The flying device of claim 2, wherein said slot is circularly overcut at each end and contains a notch at a center thereof.

16. The flying device of claim 1, wherein said axis of rotation means is a dowel attached to said airfoil by a plurality of U-clamps, said dowel being wrapped by resilient foam rubber material at a location under said plurality of U-clamps.

17. The flying device of claim 16, wherein said dowel is removably replaceable from under said plurality of U-clamps.

18. The flying device of claim 4, wherein said bearings are integral with said bridle.

19. The flying device of claim 18, wherein said bearings include at least three holes.

20. A rotary flying device comprising:

an airfoil;

a stabilizer disk having a slot, said disk placed over and centered on said airfoil, thereby creating an intersection, said slot being circularly overcut at each end;

tape means at said intersection for creating a double hinge to allow for rotation of said disk about said hinge, said disk being in a flying position when perpendicular to said airfoil and said disk being in a folded position when fully rotated to contact said airfoil, the circularly overcut ends preventing said disk from tearing when fully rotated;

a dowel fixedly secured along the longitudinal axis of said airfoil, said dowel having two ends, said ends extending beyond each end of said airfoil;

a bearing assembly attached to each end of said dowel, said bearing assembly comprising a bearing, a spacer, and an end cap;

a bridle attached to each of said bearing assembly on each end of said dowel, wherein said bearing includes a streamer attachment means for attaching a streamer thereto for added stability during flight.

21. The flying device of claim 20, wherein said bearing contains three holes, one hole for receiving said dowel, one hole for receiving said bridle, and one hole for receiving a streamer.

22. The flying device of claim 20, wherein said streamer contains a tubular member located at said bearing assembly for preventing said streamer from entangling with said rotary flying device.

23. The flying device of claim 20, wherein at least one means for stabilizing is removably attached to said disk and said airfoil, at said intersection, to secure said disk in said flying position.

24. The flying device of claim 20, wherein said dowel is attached to said airfoil by a plurality of U-clamps, said dowel being wrapped by resilient foam rubber material at a location under said plurality of U-clamps.

25. The flying device of claim 20, wherein said bridle is integrally formed with each of said bearing of said bearing assemblies.

26. A rotary flying device comprising:

an airfoil having an axis of rotation means for rotation thereabout;

a bearing assembly means for enabling a streamer to be attached to the flying device;

a stabilizer disk mounted on said airfoil, said stabilizer disk forming an intersection with said airfoil and being pivotable about said intersection from a flying position substantially perpendicular to said airfoil to a portable position substantially parallel to said airfoil; and at least one stabilizer element removably attached to at least one of said disk and said airfoil at said intersection to securely hold said disk in said flying position and to prevent said disk from pivoting during flight for added stability during flight, said at least one stabilizer element removable to allow said disk to pivot to said portable position while not in flight.

27. A bearing means for connecting to a dowel rod of a rotatable kite so as to enable a bridle to be connected to the kite and at least one streamer to be attached to the kite for added stability during flight, said bearing means comprising:

a substantially rectangular flange having a plurality of holes including a first end hole, a dowel receiving hole, and a second end hole in said flange, said dowel receiving hole receives said dowel rod which rotates therein, the bridle of said kite is attached to said first end hole, said second end hole is capable of attaching said streamer.

28. The bearing of claim 27, wherein said plurality of holes further includes at least one free hole, said at least one free hole capable of attaching additional attachments.

29. The flying device of claim 26, wherein said at least one stabilizer element includes two square blockers.

30. The flying device of claim 26, wherein said at least one stabilizer element includes four quartered spherical blockers.

* * * * *